United States Patent [19]

Clarke et al.

[11] 4,188,304

[45] Feb. 12, 1980

[54] DETERGENT COMPOSITION IN A WATER-INSOLUBLE BAG HAVING A WATER-SENSITIVE SEAL

[75] Inventors: David E. Clarke; James F. Davies, both of Wirral; John B. Tune, Higher Bebington, all of England

[73] Assignee: Lever Brothers Company, New York, N.Y.

[21] Appl. No.: 905,680

[22] Filed: May 15, 1978

[30] Foreign Application Priority Data

May 18, 1977 [GB] United Kingdom ..... 20934/77

[51] Int. Cl.[2] ..... C11D 17/04

[52] U.S. Cl. ..... 252/93; 150/3; 206/0.5; 252/90

[58] Field of Search ..... 252/90, 91, 92, 93; 206/0.5; 150/3; 220/DIG. 30

[56] References Cited

U.S. PATENT DOCUMENTS

| | | | |
|---|---|---|---|
| 2,750,027 | 6/1956 | Cummings | 206/0.5 |
| 3,198,740 | 8/1965 | Dunlop et al. | 252/90 |
| 3,279,511 | 10/1966 | Griffin | 220/DIG. 30 X |
| 3,347,297 | 10/1967 | Garland | 220/DIG. 30 X |
| 3,816,321 | 6/1974 | Kleinschmidt | 252/91 X |
| 3,892,905 | 7/1975 | Albert | 252/90 X |
| 3,989,638 | 11/1976 | Bradley et al. | 252/90 X |
| 4,085,052 | 4/1978 | Murphy et al. | 206/0.5 X |
| 4,149,977 | 4/1979 | Morganson et al. | 206/0.5 X |

*Primary Examiner*—Harris A. Pitlick

*Attorney, Agent, or Firm*—Kenneth F. Dusyn; James J. Farrell

[57] ABSTRACT

A detergent product comprises a particulate detergent composition contained within a closed water-insoluble bag which has a water-sensitive seal, whereby the contents of the bag are discharged on contact of the bag with water. Use of such detergent products improves detergent dosage control and hence cost-effectiveness, and is particularly beneficial for detergent compositions of higher density than customary or which contain water-insoluble ingredients.

9 Claims, 2 Drawing Figures

DETERGENT COMPOSITION IN A WATER-INSOLUBLE BAG HAVING A WATER-SENSITIVE SEAL

Figure 1:
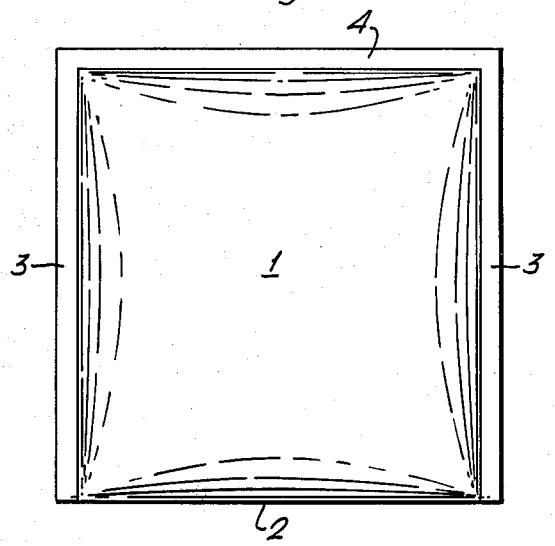

The invention relates to detergent products which are suitable for fabric washing purposes and which contain detergent compositions in powder form.

Although the marketing of powdered detergent compositions packaged in cartons is common practice, this imposes constraints both on their formulation and methods of production. For example the powders must be free flowing and have an attractive appearance to the consumer, and the ingredients should not segregate during transport and storage. The products must also be safe, both for contact with the skin and in the event of accidental ingestion. In particular, the compositions should not be too highly alkaline in aqueous solution, although a degree of alkalinity is beneficial for detergent properties. When using washing machines which have a rotating drum in which the fabrics are placed, there can also be substantial losses of detergent powder by retention in the dispenser and by its accumulation in the dead spaces beneath the drum, such as the drain hose, when using conventional detergent powder dosing methods. In addition, the sale of detergent compositions in powder form can introduce dosing problems, as the consumer commonly uses either too much or too little detergent powder in the washing machines for optimum detergency under the prevailing conditions.

It has been proposed previously to market detergent compositions in packages, each of which contain suitable amounts of the detergent powders for standard washing conditions. In particular, the detergent powders can be contained within bags of either water-soluble materials or water permeable materials, or they can be compressed into tablet or cake form. But such packages have not met with much commercial success as yet, one of the problems being the difficulty of making the products strong enough for satisfactory transport and storage properties, whilst yet permitting the contents to disperse in the wash liquor very quickly during use.

According to the present invention a detergent product comprises a particulate detergent composition contained within a closed water-insoluble bag which has a water-sensitive seal, whereby the contents of the bag are discharged on contact of the bag with water. In practice the bags should open quickly to discharge their contents within at least five minutes and preferably within two minutes of the start of the washing process, ie when sufficient water has been admitted to the washing machine to immerse the bag when agitation is commenced. The best products are capable of opening and discharging their contents within about 15 seconds to one minute of commencing the washing process, whilst still being strong enough to prevent leakage through the seams during handling prior to use.

The detergent products of the invention give consumer benefits both by way of improved cost-effectiveness and in convenience of use. In particular, by using a bag with a water-sensitive seal, it becomes possible to use cheaper, substantially powder-impermeable materials to form the bag. Detergent compositions can then be used in the bags with greater safety than otherwise, for example more highly alkaline materials can be used than in powders which contact the skin.

A further advantage of the use of the products of the invention is that the detergent powders can be of higher density than usual, which decreases packaging, storage and transport costs. This can also simplify powder processing techniques, for example acceptable powders can be prepared entirely by simple admixture or by granulation, because a good appearance for the powders is less important for commercial acceptance of the products. There is also increased economy of use due to avoiding the dispenser residues and loss of powder in the dead spaces of washing machines, as occur with conventional powders supplied in cartons, together with closer dosage control which tends to improve detergency by eliminating under-dosing.

The bags used to form the products of the invention may be constructed of paper, of woven, knitted or non-woven fabric or of plastic sheet material. The bags should be water-insoluble but can be water-permeable or non-permeable; if water-permeable, the pores should be small so that there is no substantial loss of detergent powder in transport or handling. Sheet materials which are substantially non-porous are preferred if the detergent powder is to contain any ingredient which is sensitive to moisture in the atmosphere or which is a skin irritant.

The materials used to form the bags are required to have a high wet strength, so as not to disintegrate during the washing process. The preferred sheet material for forming the bags is paper or thin non-woven fabric of predominantly cellulosic material of high wet strength, weighing about 10–60 g/sq m, such as is commonly used for packaging beverage powders and other foodstuffs. Suitable sheet materials of this type are commercially available, for example from J. R. Crompton & Bros. Ltd. of Bury, England. If the bags are to be used for detergent powder which contains an oxygen-liberating bleaching agent, for example sodium perborate or sodium percarbonate, it is desirable to form the bags of sheet material made from oxidation-resistant fibres, or to treat the sheet material before or after forming the bags with a coating to improve oxidation resistance. The cellulosic fibres preferably used may be of natural or synthetic origin and may be used alone or in admixture with either natural or synthetic fibres, for example polyamide, polyacrylate, cellulose acetate, polyethylene or polyacrylonitrile fibres. If natural fibres are used, it is desirable to include a proportion of long fibres such as manilla hemp, in order to improve the strength of the sheet material, and polymeric coating is also desirable for increasing wet strength.

The bags can be formed of one or more sheets or a tubular section of the sheet material, but they are preferably made of a single folded sheet or two sheets of the material bonded together at the edges with a water-soluble sealing material. For example, the bags can be rectangular sachets formed from single folded sheets and sealed on three sides so that on addition to water the seals are broken and the bags open completely to revert to the single sheets of the material of which they are constructed. Alternatively, the sheets can be folded like envelopes with overlapping flaps to be sealed, which form of construction tends to be stronger than with edge seals. The bags may also be reinforced, if desired, to decrease the risk of leakage during handling, for example by adding an extra thickness of the sheet material where the bags are expected to be held or passing completely round the bags to help support the weight of detergent powder.

If desired, the sheet material used to form the bag can be marked or tagged so that it can be easily recognised amongst the washed fabrics, for example the material may be printed with a simulated fabric pattern such as check or gingham. It can then either be discarded, or if desired it may be constructed of a suitable material to provide it with a secondary use, for example as a cleaning cloth or handkerchief.

If desired, the bags can be formed with more than one separate compartment for different detergent ingredients, or the bags may be formed in a conjoined manner, for example in a strip to facilitate dosing of different numbers of the bags as appropriate for the wash conditions. The use of multicompartment bags facilitates the use of detergent ingredients which interact with other ingredients in detergent compositions, whilst avoiding encapsulation or other treatment to prevent contact between such ingredients in a single composition.

The water-sensitive seals in the bags are most conveniently formed by using a water-soluble adhesive at one or more edges of the bags. Suitable water-soluble adhesives can, for example, be based on polysaccharides such as starch or dextrin, synthetic polymers such as polyvinyl alcohol, or alkali metal silicates. Small amounts of plasticisers, for example ethylene glycol, can be added to the water-soluble adhesives, if desired.

Any detergent composition in powder form can be packaged to advantage in the products of the invention. Such detergent compositions are amply described in the literature, for example in "Surface Active Agents and Detergents", Volumes I and II, by Schwartz, Perry & Berch.

However, the products of the invention are advantageously used for detergent powders containing insoluble ingredients. Specific compositions of this type which may be mentioned by way of example, are those described in UK Pat. No. 1,437,950, which describes detergent compositions comprising from 5 to 40% of a detergent active compound, from 10 to 75% of sodium or potassium carbonate and from 5 to 60% of finely divided calcium carbonate. Examples of such detergent compositions which are especially adapted for use in the products of the invention are also described in our copending United States patent application Ser. No. 905,681 of even date. Other detergent compositions comprising insoluble ingredients which are suitable for use in the products of the invention are those which comprise organic or inorganic ion-exchange materials as detergency builders, for example the sodium aluminosilicates described in UK patent application Nos. 1,429,143, 1,473,201 and 1,473,202.

The products of the invention are also suited for use with the alkaline particulate detergent compositions described in the German patent application No. 2637890. These compositions comprise from 5 to 30% of a synthetic detergent compound and from 10 to 30% of mixed sodium tripolyphosphate and alkali metal orthophosphate in the ratio of 10:1 to 1:5 parts by weight, the amount of sodium tripolyphosphate being at least 5% and the amount of any alkali metal pyrophosphate being not more than 5% of the composition.

If desired, minor ingredients of the detergent compositions, for example fluorescent agents or anti-redeposition agents such as sodium carboxymethylcellulose, may be impregnated on the bag itself for addition to the wash liquor.

The invention is illustrated by reference to the following Examples in which parts and percentages are by weight except where otherwise indicated.

EXAMPLE 1

Detergent bags in sachet form were made from non-woven sheet material weighing 27 g/m$^2$ which was formed of mixed cellulosic and thermoplastic fibres with a thermoplastic polymeric coating on one side of the material. Pieces of the sheet material measuring approximately 9"×4½" (23 cm×11.5 cm) were folded midway and then sealed along two opposing edges with ¼" wide strips of aqueous sodium alkaline silicate solution (48% solution) containing about 5% of ethylene glycol. Thorough closure of these seals was assured by brief heating under pressure.

The resultant open bags measured about 4½"×4½" (11.5 cm square) and were each filled with 90 g of a high density detergent powder of the following composition, prepared as described in our aforementioned patent application Ser. No. 905,681, and then sealed along the open edge in the same way as described above:

| Ingredient | % |
|---|---|
| Nonionic detergent compound | 15 |
| Sodium carbonate | 35 |
| Calcium carbonate (80 m$^2$/g) | 20 |
| Sodium silicate | 5 |
| Sodium perborate monohydrate | 20 |
| Fluorescent agents, perfume | 1 |
| Water (of hydration) | 4 |

It was found that the filled bags were strong enough not to burst readily during handling even though nearly full of the detergent powder, and there was very little dusting of the powder through the non-woven material used. On contact with water in a washing machine the bags were found to discharge their contents within one minute.

A filled bag of this type is shown in FIG. 1 of the accompanying drawing which is a schematic elevation. The bag in FIG. 1 has a substantially completely filled square body part 1 with one lower edge 2 formed by folding and two side edges 3 and a top edge 4 formed by adhesive sealing between the sheets of material forming the bag.

Comparative tests were undertaken in which the washing performance was measured for the sachet packaged products against the same powder dosed conventionally in the dispenser of a front loading automatic washing machine, and it was found that the washing results with the former were generally preferred.

In a further comparative test, the sachet packaged products were tested against a conventional leading commercially available low sudsing detergent composition containing 33% of sodium tripolyphosphate and 22% sodium percarbonate, both at equal dosage levels by weight, but with the conventional composition being dosed in the dispenser. It was found that there was generally similar performance for both products, but with noticeable benefits in bleachable stain removal for the sachet packaged product under conditions of use in hard (25° F.) water at 95° C.

EXAMPLE 2

Figure 2:
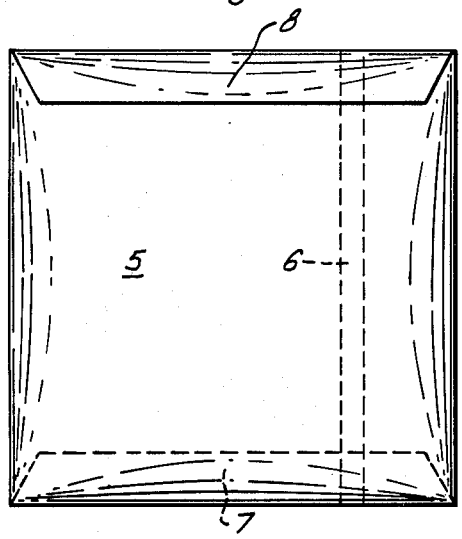

Detergent bags in sachet form were made from cellulosic paper of high wet strength with the form of construction as shown in FIG. 2. The bag represented in schematic elevation is formed of a single sheet of paper 5 with a longitudinal glued seam 6 and a bottom folded glued seam 7. The top flap 8 is closed by adhesive under pressure after filling with detergent powder. This form of construction is particularly suitable for accomplishing automatically on available types of machinery.

Detergent bags of this type were filled with 90 g each of the powdered detergent composition as described above in Example 1 according to our copending patent application Ser. No. 905,681 and evaluated against the same product used under identical washing conditions. The bags were added to washing machines on top of the fabrics to be washed, whilst the loose powder was dosed conventionally in the washing machine dispenser. The results of the halved article tests in Miele machines using product concentrations of 0.4% in water of 25° H at 60° C. showed a significant preference for the washing performance when using the detergent bags.

EXAMPLE 3

Sachets were constructed of high wet strength fine filter paper and filled with 64 g each of the detergent powder containing sodium carbonate and calcium carbonate as described in Example 1 above. Some of the sachets were sealed with water-soluble polyvinyl alcohol adhesive and some with water-insoluble adhesive.

The two types of sachets were then compared in detergency tests using automatic Miele washing machines at a product concentration of 0.4% in 25° H water at 40° C. The results on halved article washing tests showed the sachets with water-sensitive seals to be significantly superior to the sachets which remained closed during the wash cycle. Comparative tests were also accomplished using similar sachets containing 80 g each of detergent powder, when significantly superior results were again achieved at product concentrations of 0.5% at a wash temperature of 60° C.

What is claimed is:

1. A detergent product comprising a particulate detergent composition contained within a closed water-insoluble bag which has a water-sensitive seal, whereby the contents of the bag are discharged on contact of the bag with water.

2. A detergent product according to claim 1, wherein the bag is formed of paper or non-woven fabric of cellulosic fibres.

3. A detergent product according to claim 1, wherein the bag is formed of a folded rectangular sheet material with three edge seals.

4. A detergent product according to claim 1, wherein the bag is formed of a folded rectangular sheet material with a longitudinal seam and top and bottom edge seals.

5. A detergent product according to claim 1, wherein the seals are formed with water-soluble adhesive.

6. A detergent product according to claim 1, wherein the sheet material forming the bag is treated with polymeric coating to increase its wet strength.

7. A detergent product according to claim 1, wherein the sheet material forming the bag is substantially non-porous to moisture.

8. A detergent product according to claim 1 having more than one compartment in the bag.

9. A detergent product according to claim 1, wherein the particulate detergent composition comprises a water-insoluble ingredient.

* * * * *